US010683019B2

(12) United States Patent
Laffin

(10) Patent No.: US 10,683,019 B2
(45) Date of Patent: Jun. 16, 2020

(54) EDDY CURRENT VEHICLE DRIVE

(71) Applicant: DISNEY ENTERPRISES, INC., Burbank, CA (US)

(72) Inventor: Kristopher M. Laffin, Glendora, CA (US)

(73) Assignee: Disney Enterprises, Inc., Burbank, CA (US)

( * ) Notice: Subject to any disclaimer, the term of this patent is extended or adjusted under 35 U.S.C. 154(b) by 436 days.

(21) Appl. No.: 15/659,851

(22) Filed: Jul. 26, 2017

(65) Prior Publication Data

US 2019/0031209 A1 Jan. 31, 2019

(51) Int. Cl.

| | |
|---|---|
| ***B61C 3/00*** | (2006.01) |
| ***B61B 13/00*** | (2006.01) |
| ***A63G 7/00*** | (2006.01) |
| ***A63G 21/04*** | (2006.01) |
| ***B61B 13/12*** | (2006.01) |

(52) U.S. Cl.

CPC ..... *B61C 3/00* (2013.01); *A63G 7/00* (2013.01); *A63G 21/04* (2013.01); *B61B 13/00* (2013.01); *B61B 13/12* (2013.01)

(58) Field of Classification Search

CPC .. B61C 3/00; A63G 7/00; A63G 21/04; B61B 13/00; B61B 13/02

See application file for complete search history.

(56) References Cited

U.S. PATENT DOCUMENTS

| | | | | |
|---|---|---|---|---|
| 5,595,121 | A * | 1/1997 | Elliott | A63G 7/00 104/288 |
| 6,971,317 | B2 * | 12/2005 | McKoy | A63G 33/00 104/53 |
| 8,117,968 | B2 * | 2/2012 | Rose | A63G 7/00 104/53 |
| 8,132,513 | B2 * | 3/2012 | Crawford | A63G 7/00 104/53 |
| 10,315,120 | B2 * | 6/2019 | McVeen | A63G 7/00 |
| 2005/0011399 | A1 * | 1/2005 | Skoblenick | B61B 13/04 105/144 |
| 2008/0148990 | A1 * | 6/2008 | Wamble | B60L 13/04 104/281 |
| 2009/0269175 | A1 * | 10/2009 | Rose | A63G 7/00 414/373 |
| 2011/0088584 | A1 * | 4/2011 | Baker | A63G 7/00 104/74 |
| 2019/0031209 | A1 * | 1/2019 | Laffin | B61B 13/00 |

* cited by examiner

*Primary Examiner* — Jason C Smith

(74) *Attorney, Agent, or Firm* — Snell & Wilmer L.L.P.; Kent A. Lembke

(57) ABSTRACT

A ride that includes an eddy current vehicle drive, and the ride may take the form of a roller coaster with a lift hill. The eddy current vehicle drive includes an eddy current generator with a vehicle-mounted element and a support-mounted element. The "support" in this ride may be a chain similar to a chain lift system's chain with its drive components. The eddy current vehicle drive may use equipment that is similar to a traditional roller coaster chain lift. The chain has a support-mounted element of the eddy current generator (such as a set of conductor fins) mounted on each link of the chain to form a continuous or nearly-continuous (with small gaps between adjacent pairs of the plates) conductor that extends vertically from the chain. The vehicle's body has a magnet or magnet array to provide the vehicle-mounted element (portion or half) of the eddy current generator.

20 Claims, 5 Drawing Sheets

EDDY CURRENT VEHICLE DRIVE

BACKGROUND

1. Field of the Description

The present description relates, in general, to mechanisms for driving or moving a vehicle, such as a passenger vehicle for an amusement or theme park ride, and, more particularly, to systems and methods for driving or moving a vehicle along a track or along a path through application of an outside force. In one example, a drive system and drive method is provided for lifting a roller coaster vehicle up a lift hill.

2. Relevant Background

There are many applications where it is desirable to drive or move a vehicle, such as a wheeled or rollable passenger vehicle, a floating vehicle/boat, or the like, in a guided manner up or down a track or along a path. Often, it is useful to drive the vehicle by applying an outside driving force upon the vehicle so that an onboard engine or motor is not required or used for this portion of the vehicle's travel on the track or along the path. Generally, it is desirable for the outside force to be applied in a relatively efficient manner with limited impact with the vehicle's body and/or wear on the drive system, with minimal load upon the vehicle's passengers, and with a drive system that does not require significant maintenance over its useful life.

For example, a traditional roller coaster uses chain lifts or drives that physically "catch" vehicles (e.g., via engagement between a hook on the bottom of the vehicle and a link on the chain). The chain lift catches or engages the vehicle as it approaches a stretch of the coaster's track where it's desired to drive or move the vehicles such as for launching the vehicles or for loading/unloading passengers. The chain lift moves the captured vehicle uphill, in a lift hill application, using a motor drive system that moves the chain uphill, with the chain often being positioned in the middle of the track below where the vehicle wheels contact and engage the track's rails.

While chain lifts have proven useful for many years in roller coasters and other rides, the physicality of a traditional chain lift leads to mechanical wear of the drive system since the vehicle equipment physically contacts and rubs the chain equipment (e.g., a chain link). As a result, the chain lift-type drive system requires significant and costly maintenance to avoid failure of the drive or its components.

The direct contact with the vehicle can also result in high passenger impact loads and accelerations when the vehicle is transitioning onto the chain lift (or chain-based drive system). The high impact loads are experienced by the passengers of the vehicle when the "catch" system slips (e.g., the vehicle's hook misses a chain link/rung), allowing the vehicle to drop backward downhill to the next rang or link in the chain. The vehicle will then gain speed rolling back down the hill until it reaches the next chain rung. When it catches on this rung, there is a rapid change of direction since the vehicle is traveling down while the chain is traveling up. This rapid change in direction creates a large acceleration that translates to the passengers of the vehicle.

In addition to higher passenger loads, the "slipping" experienced during use of chain drives leads to high variability in the forces on the vehicle. This variability often requires an increase in engineering and manufacturing costs to ensure the drive system (or ride/transportation system) is safe even with these more difficult to predict loads. Often, drive systems (e.g., park rides) are over designed, which leads to a significant increase in overall cost. Since the variable vehicle loads are not known, in many cases, until the system is built and tested, the designers often assume the loads are going to be much higher than identified in later testing.

Another known limitation with chain drives is that because the lift's chain is mechanically linked to the vehicle all vehicles that are on the same lift chain can only travel at one speed, i.e., at the velocity of the chain in the drive system. In the roller coaster or ride setting, this removes the possibility of using the lift (or other driven) section of the ride path as a way to account for loading and/or attraction inefficiencies that can reduce the overall throughput of the ride and can cause show timing issues as well.

A further limitation with the use of chain drives is that because the system may fail, mitigation devices or assemblies are required, which further increases the cost of such drives. Specifically, it is unacceptable for the vehicle to roll un-interrupted backwards down a hill if the "catch" system were to fail. Hence, to mitigate this risk, existing chain lifts or drives include a separate anti-rollback (ARB) system to ensure the vehicle keeps from rolling backwards in the event of failure of any of the components used to "catch" the vehicle. This additional ARB system also requires physical interaction between the vehicle's body or equipment and the ARB system's components or equipment, which leads to additional system mechanical wear and increases maintenance costs and requirements.

SUMMARY

Briefly, a system (and corresponding method) is provided for driving or moving a vehicle a predefined distance along a path (such as along a length of track of an amusement or theme park ride) through the application of outside motive forces upon the vehicle's body. The inventor recognized that a vehicle may be driven along a track or path by generating an eddy current, and, hence, the system may be labeled an eddy current vehicle drive that is able to drive a vehicle without requiring physical contact and/or engagement between the vehicle and the exterior drive devices. One useful, but not limiting application, would be to replace conventional chain lifts for lifting roller coaster (and other ride) vehicles up a lift hill in an amusement or theme park ride, but the new eddy current vehicle drive will likely have uses in any application where it is desirable to move a vehicle a distance along a predefined path without the need for an onboard engine/motor.

The proposed eddy current vehicle drive operates on the proven electrodynamic theory of eddy currents. In general, an eddy current is created when a conductor (e.g., copper, aluminum, or other conductive material in a plate or another form/shape) comes in contact with a magnetic field at any reference (or relative) velocity greater than zero (where "reference velocity" is defined as the difference in velocity between the conductor and the magnetic field). When the conductor sees (or is placed within/near) the magnetic field, it creates a magnetic field that opposes the magnetic field that it sees (or is being applied upon it). This means that when a conductor passes through a magnetic field that it sees (e.g., when a conductor passes through a magnetic field at a certain velocity), it creates an opposing magnetic field (or drive force) that tries to reduce the difference in velocities to zero. Such opposition of magnetic fields acts as a brake between the magnetic field and the conductor if one of the parts is not moving. The inventor recognized, though, that if one of the two elements (the conductor or the magnetic field) is actively being moved, and the other element is free to move in the same direction (i.e., is not fixed), then the eddy current effect will try to keep the non-moving element/part moving at the same velocity as the moving element/part.

For example, a vehicle (or movable object) may be configured to include a magnet(s) and to roll upon a track and a conductor may be provided upon a moving platform/support (e.g., a series of plates formed from conductive material may be mounted on a moving chain, belt, or the like). In this example (e.g., a roller coaster or similar ride) since the vehicle is able to move freely on the track (e.g., rails of a roller coaster or other ride track), the vehicle is moved with the movement of the conductor due to the creation and application of the eddy current force. In the eddy current vehicle drive, the two elements/parts are considered an eddy current generator and one of the two elements/parts will be mounted upon the vehicle while the other will be mounted or supported upon the movable/drivable platform or support. Hence, one element/part of the eddy current generator is labeled a vehicle-mounted element (or member) and one element/part of the eddy current generator is labeled a support-mounted element (or member). To generate the eddy current, sonic embodiments are adapted such that the vehicle-mounted element is the conductor and the support-mounted element is one or more magnets (or magnetic field generators) while other embodiments are adapted such that the vehicle-mounted element is a magnet(s) (or magnetic field generator(s)) and the support-mounted element is a conductor(s).

In one particular embodiment, a ride is described that includes an eddy current vehicle drive, and the ride may take the form of a roller coaster or similar ride with a lift hill or stretch of track where it is desired to move a ride vehicle along a distance of the track. The vehicle is configured to roll upon rails of the track. The eddy current vehicle drive includes an eddy current generator with a vehicle-mounted element and a support-mounted element. The "support" in this ride may be a chain (or belt or the like) similar to a chain lift system's chain with its drive components. Hence, in this example, the eddy current vehicle drive may use equipment that is similar to a traditional roller coaster chain lift. It has a drive system for driving the support, and the drive system may include a motor, a gearbox, a drive shaft, and drive chain. In the new drive, though, the chain will have a support-mounted element of the eddy current generator (such as a conductor fins) mounted on each link of the chain (or a set of the links) to form a continuous or nearly-continuous (with small gaps between adjacent pairs of the plates) conductor that extends vertically from the chain.

Instead of the vehicle's body having a chain pawl/hook that physically engages with the chain links to mechanically link it, the vehicle's body has a magnet or magnet array to provide the vehicle-mounted element (portion or half) of the eddy current generator. For example, the magnet or magnet array may be provided on the bottom (or top) of the vehicle body and be arranged to have a U-shaped cross-sectional shape (upside down, elongated "U") and a desired length (e.g., 0.25 to 1 meters or the like), whereby a channel is defined for receiving the plates of conductive material provided by the support-mounted element. During operation of the ride when the vehicle rolls into the section of track with the support-mounted element (and its drive system), the magnet passes on either side of the conductor (plate, fin, or the like) without physically touching the conductor on the moving support (e.g., moving drive chain).

While a vehicle is on a lift hill (or other portion of the track in a ride), the chain (moving support) will be driving in an upwards direction (or along the path defined by the ride track) using the motor and gearbox in a manner similar to the way a traditional chain lift operates (e.g., move the "captured" vehicle up the hill at a similar velocity to the moving chain acting as a support for the plates (or the conductor)). The conductor fin/plate on the chain will be creating an eddy current with the vehicle magnet that is trying to keep the vehicle at the same speed as the lift chain, thus carrying the vehicle up the lift hill without physically touching any part of the vehicle. Since there is no part of the vehicle that physically touches any part of the chain lift, there is no mechanical wear on an these parts, which eliminates the possibility of failure due to wear.

More particularly, a system is provided for moving or driving vehicles at a desired velocity through a space by applying a non-contact driving force. The system includes a vehicle configured to be movable along a predefined path. The system further includes a support and a support drive assembly operable to move the support at a support velocity along a travel path that is proximate to and parallel to the predefined path. The system also includes an eddy current generator, which includes a vehicle-mounted element and a support-mounted element. The vehicle-mounted element is supported on a surface of a body of the vehicle that faces the predefined path, and the support-mounted element is positioned on the support to face the vehicle when the vehicle is moved onto the predefined path at a vehicle velocity differing from the support velocity. During system operations, the eddy current generator generates an eddy current to apply a drive force on the body of the vehicle to drive the vehicle along the predefined path.

In some implementations, the support includes a chain, a belt, or a cable. As one non-limiting example, the support velocity can be greater than 0.5 m/s, and the vehicle velocity differs from the support velocity by at least 0.05 m/s (with some testing showing a reference velocity of 0.1 m/s or more being useful). The vehicle-mounted element often takes the form of a magnet while the support-mounted element is a conductor. In such cases, the magnet may have a U-shaped cross sectional shape defining a channel between two sidewalls. Then, the conductor may be a planar plate(s) extending outward from the support, and the planar plate(s) is received within the channel when the eddy current generator generates the eddy current (e.g., the planar plate extends upward toward the vehicle so as to extend into the channel a distance to define a pole projection area adequate to generate a desired driving force via eddy current generation). The magnet may include one or more permanent magnets, and the conductor may be formed as fins or plates of an electrically conductive material such as aluminum, copper, or other highly conductive metal. In other embodiments, though, the vehicle-mounted element is a conductor and the support-mounted element is a magnet or magnet array.

With the use of the eddy current drive generator, the drive force is applied without physical contact or linkage between the body of the vehicle and the support-mounted element. Also, the support-mounted element and the vehicle-mounted element are positioned to be spaced apart but with a relatively small clearance (e.g., less than 5 centimeters) as the vehicle travels along the predefined path so as to provide a more efficient eddy current generator.

DETAILED DESCRIPTION

An eddy current vehicle drive is presented that is useful for driving or moving a vehicle through a space along a predefined path through the application of an outside motive or driving force. The new drive applies this force in a non-contact manner without the need for mechanical linkage between the vehicle and the drive's components. The eddy current vehicle drive may be used for example to drive a passenger vehicle, such as an amusement or theme park ride vehicle, along a track or through an open space, and the predefined path may be an uphill section of a ride/track, a downhill section of the ride/track, or a horizontal or "flat" stretch of the ride/track.

Generally, the eddy current vehicle drive includes a support assembly with a support and a support drive assembly configured for moving the support along or adjacent to the predefined path. For example, the support may take the form of a chain, a belt, a cable, or the like, and the support drive assembly may include a motor, pulleys, and the like (such as for a conventional chain lift assembly of a roller coaster) that are operable to move along or adjacent to the predefined path in an ongoing/continuous manner (or in a selective manner in some cases) at a chosen velocity (or at one or more speeds or at a speed within a range of velocities).

The eddy current vehicle drive further includes an eddy current generator that includes a support-mounted element and a vehicle-mounted element. The eddy current generator is adapted to generate an eddy current when the vehicle is positioned proximate to the support, which is moving at a velocity that differs from the velocity of the vehicle. The eddy current generator includes a magnetic member (e.g., a magnet or array of magnets) and a conductor or conductive member (e.g., a plate or series of plates formed of a conductive material such as aluminum, copper, or other metal), and either of these members may be provided on the vehicle or on the support. For example, the vehicle-mounted element may be the magnetic member while the support-mounted element is a conductor member or vice versa.

The particular configurations and applications of the new eddy current vehicle drive are numerous and diverse, but it may be useful at this time to provide a specific example from which those skilled in the art will readily understand the extension of the drive into other applications. Specifically, the eddy current vehicle drive may be used to replace one or more chain lifts of a roller coaster or similar park ride to lift (or move) roller coaster vehicles (passenger vehicles) up a hill (or otherwise along the coaster's track) without contact with the vehicle and without mechanical linkage being required.

Figure 1:
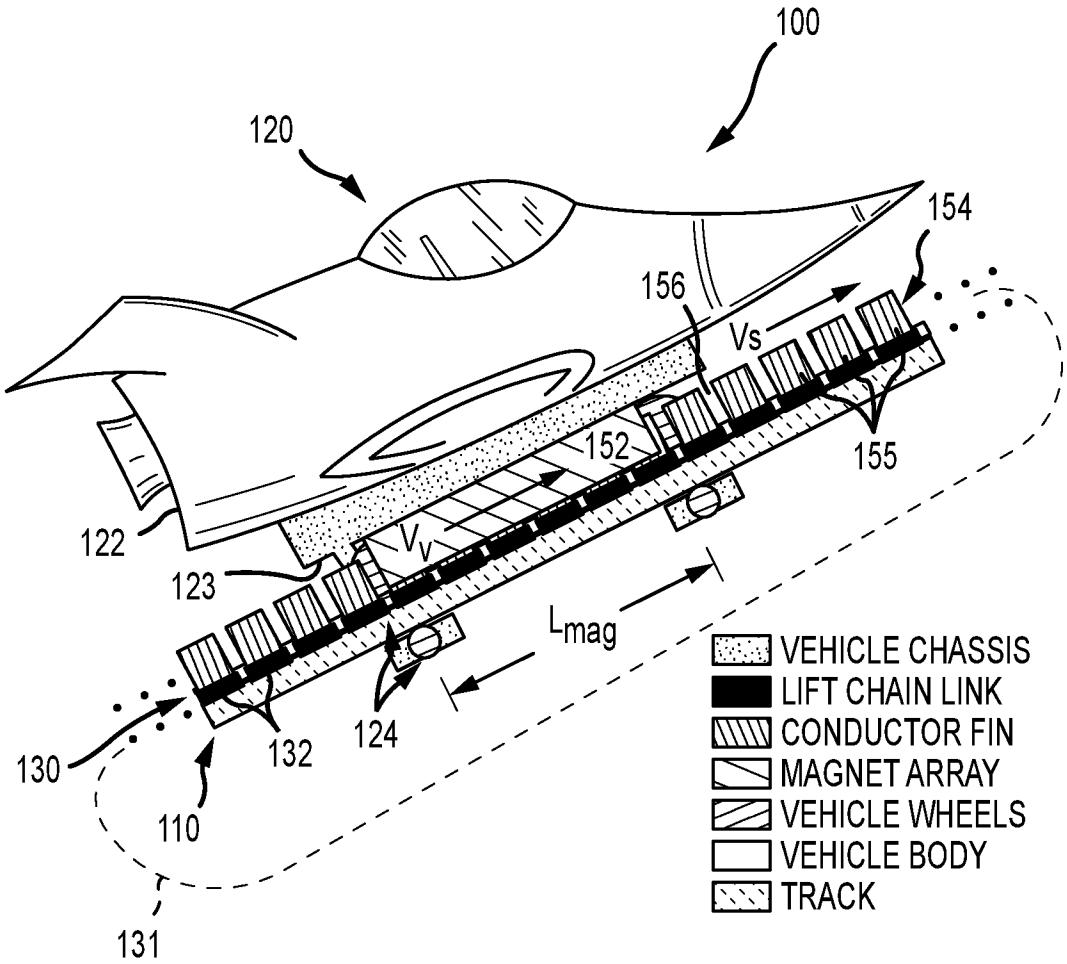
FIG. 1 is a partial side view of a ride (e.g., a roller coaster) illustrating use of an eddy current vehicle drive of the present description to move/lift a vehicle (e.g., a roller coaster passenger vehicle) up a lift hill.
Figure 2:
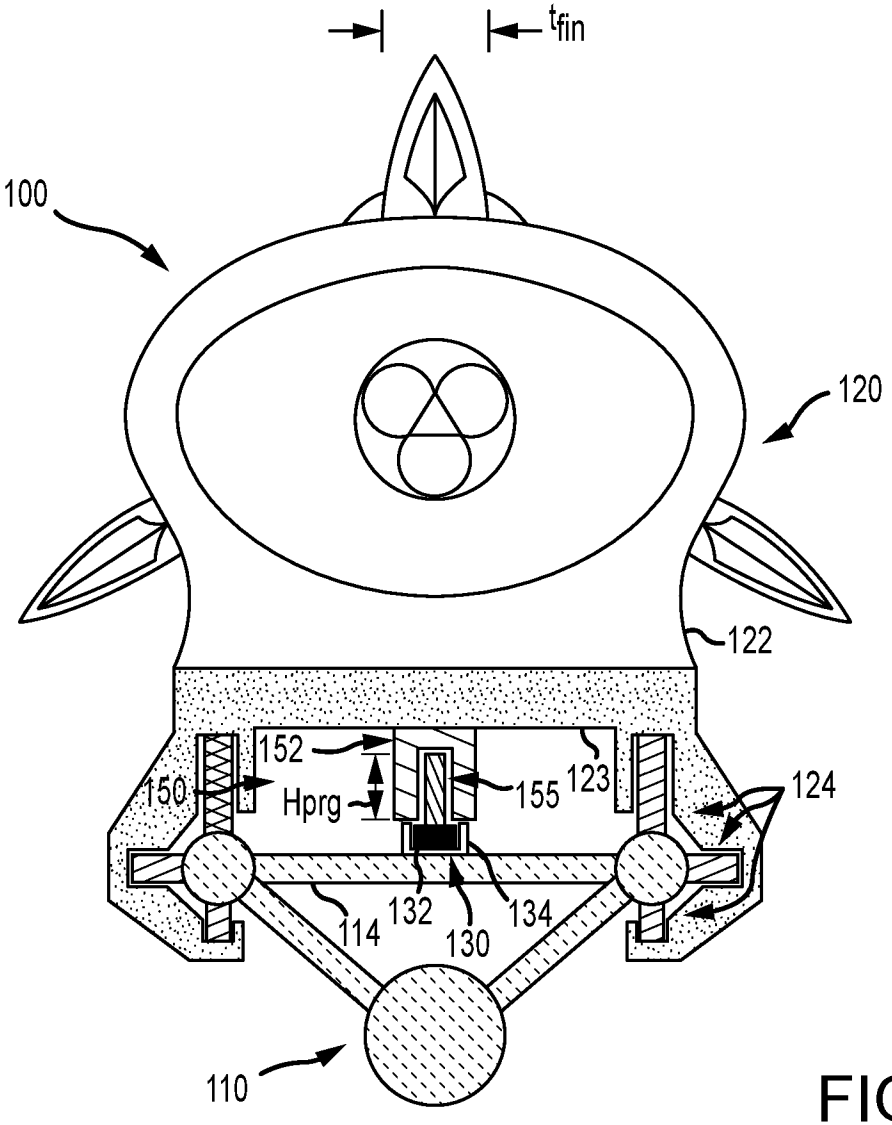
FIG. 2 is an end view of the ride of FIG. 2 showing the eddy current generator elements in greater detail.

FIG. 1 is a partial side view of a ride (e.g., a roller coaster) 100 illustrating use of an eddy current vehicle drive 150 of the present description to move/lift a vehicle (e.g., a roller coaster passenger vehicle) 120 up a lift hill. FIG. 2 is an end view of the ride 100 of FIG. 1 showing elements of the eddy current generator 150 in greater detail. As shown in FIGS. 1 and 2, the ride 100 includes a track-based vehicle 120 that has a body 122 with a chassis 123 from which a set of wheels (or a bogie assembly or the like) 124 extends, and the wheels 124 are configured to roll upon and retain the vehicle 120 upon the rails of the ride's track 110. In the section of the ride or length of track 110 (defining a predefined path in the ride 100), one or more crossbars or lateral members 114 extend between the two rails of the track 110 (e.g., above a main structural member as shown in FIG. 2). In FIG. 1, it can be seen that the vehicle 120 is moving along the track 110 at a particular velocity, $V_V$, which as explained herein differs at least a small amount from the support element to generate an eddy current.

The ride 100 further includes a support 130 in the form of a chain including a plurality of interconnected links or rungs 132, and, as shown in FIG. 1 with dashed line 131, the chain/support 130 extends in a continuous loop. FIG. 2 illustrates that the ride 100 includes a chain guide (or channel) 134 mounted on the upper surface of the crossbars/lateral members 114 of the track 110 so as to cause the chain links 132 to be positioned immediately below the base/lower surface 123 of the body 122 as the vehicle rolls on wheels 124 upon the rails in the section of track 110 shown in FIGS. 1 and 2. Stated differently, the guide 134 acts to position the support 130 between the wheels 124 and spaced apart a known distance from the vehicle 120 at a known location such as equally offset from the right and left wheels 124 or below the middle of the base/bottom surface 123 of the body 122.

During operations of the ride 100, a support drive assembly (not shown but understood by those in the ride arts) is operated to cause the support/chain 130 to move continuously in a loop and along the track 110 in the channel of the guide 134 such as at a continuous, known velocity, $V_S$. The velocity, $V_S$, of the support 130 may be chosen by the designers/operators of the ride 100 to be the desired velocity, $V_V$, of the vehicle 120 in this section of the track 110 (a lift hill of a roller coaster ride, for example). The support drive assembly may include a motor, two (or more) pulleys, a controller, and other components as are common in chain lift drives found in conventional coasters to move the support/chain 130 in the ride 100.

More significantly, the ride 100 includes an eddy current generator 150 that functions during operations of the ride to generate an eddy current that applies a motive/driving (non-contact) force that is applied to the body 122 of the vehicle 120 to move the vehicle 120 along the track 110 at the velocity, $V_V$ (a small amount, such as 0.1 m/s, less than the support velocity, $V_S$). The higher the efficiency of the eddy current-generator 150 the less velocity difference is needed to move the vehicle 120, which may result in the vehicle's velocity $V_V$ being nearly equal to the support velocity, $V_S$. The eddy current vehicle drive 150 includes a vehicle-mounted element 152 that in this example is an elongate magnet with a U-shaped cross section (as seen in FIG. 2 and designed to optimize the magnetic flux density that the conductor passes through), which defines a channel for receiving a conductor or fin 155 with a thickness, $t_{fin}$, less than that of the slot/channel in element 152 to allow the conductor/fin 155 to be spaced apart some small distance during operations.

The vehicle-mounted element/magnet 152 has a length, $L_{Mag}$, that may be a substantial portion of the vehicle's lower surface/base 123 with a greater length preferred to increase the size of the pole projection area of the eddy current generator 150 and its efficiency in generating an eddy current. The vehicle-mounted element 152 may be a single magnet as shown or may be provided as an array of side-by-side magnets, and the length, $L_{Mag}$, may vary to practice the invention but one in the range of 0.5 to 2 meters or more may be useful for many vehicles 120 (e.g., may be chosen on a variety of parameters such as magnet strength, size of pole projection area, weight of the vehicle, friction between the wheels 124 and track rails (e.g., resistance to rolling/moving vehicle 120), and so on). The depth of the channel in the U-shaped magnet typically is chosen to match or exceed the height of the conductor/fin/plate 155 to allow it to be wholly (or nearly wholly) received in the element 152 between the two spaced apart sidewalls of the magnet/magnet array of which it is composed.

In this example, the eddy current generator 150 also includes the support-mounted element 154 in the form of a plurality of conductors or conductive plates/fins 155, and the ride 100 is designed so that the conductors are able to pass through and be received within the channel of the vehicle-mounted element 152. More generally, the ride 100 is configured so that the conductors 155 are positioned adjacent and proximate—but spaced apart a distance (a minimum distance designed to increase eddy current generation but provide clearances on both sides of the conductor 155 to avoid contact with magnet/array 152)—to the magnet/array 152 when the vehicle 120 travels through the lift or other section of track 110 shown.

The support-mounted element 154 is shown to include a conductor or plate/fin (formed of aluminum, copper, other metal, or other conductive material) 155 mounted upon or supported upon each link/rung 132 of the moving support 130 (in the case of the use of a chain for the support 130) so that these plates/fins extend upward vertically (e.g., orthogonally from the center of the crossbar 114 or the like). A gap 156 is provided between adjacent conductors 132 to facilitate the movement of the support-mounted element 130 in a loop along with chain/support 130 by a support drive assembly, but it is desirable that this gap is kept relatively small or even eliminated in some designs (not shown) to increase the efficiency of the eddy current generator 150 by presenting as large as pole projection area as practical. The height of the fin/plate or conductor 155 is chosen to be relatively large to provide a desirable height, $H_{Proj}$, of the pole projection area (as defined by the overlap between the two elements 152 and 155 and length, $L_{Mag}$, of the vehicle-mounted element 152) such as in the range of 50 to 300 mm or more (with one prototype using 150 mm for $H_{Proj}$). In the ride, an eddy current vehicle drive may be thought of as including the eddy current generator 150 by itself or, in some cases, the support 130 (and its drive assembly) and the vehicle 120 that each carry portions of the eddy current generator 150.

With the ride 100 of FIGS. 1 and 2 understood, it will be apparent to those skilled in the arts that the eddy current generator may be provided by a wide variety of combinations of a magnet/magnet array and a conductor (which may include one-to-many individual plates/fins of conductive material). With this in mind, it may be useful to briefly describe a few other embodiments of eddy current generators that can be used with the track, support, and vehicle of ride 100 to move a vehicle up a lift hill (or other stretch of a track or along a non-tracked path of a ride) without contact being required.

Figure 3:
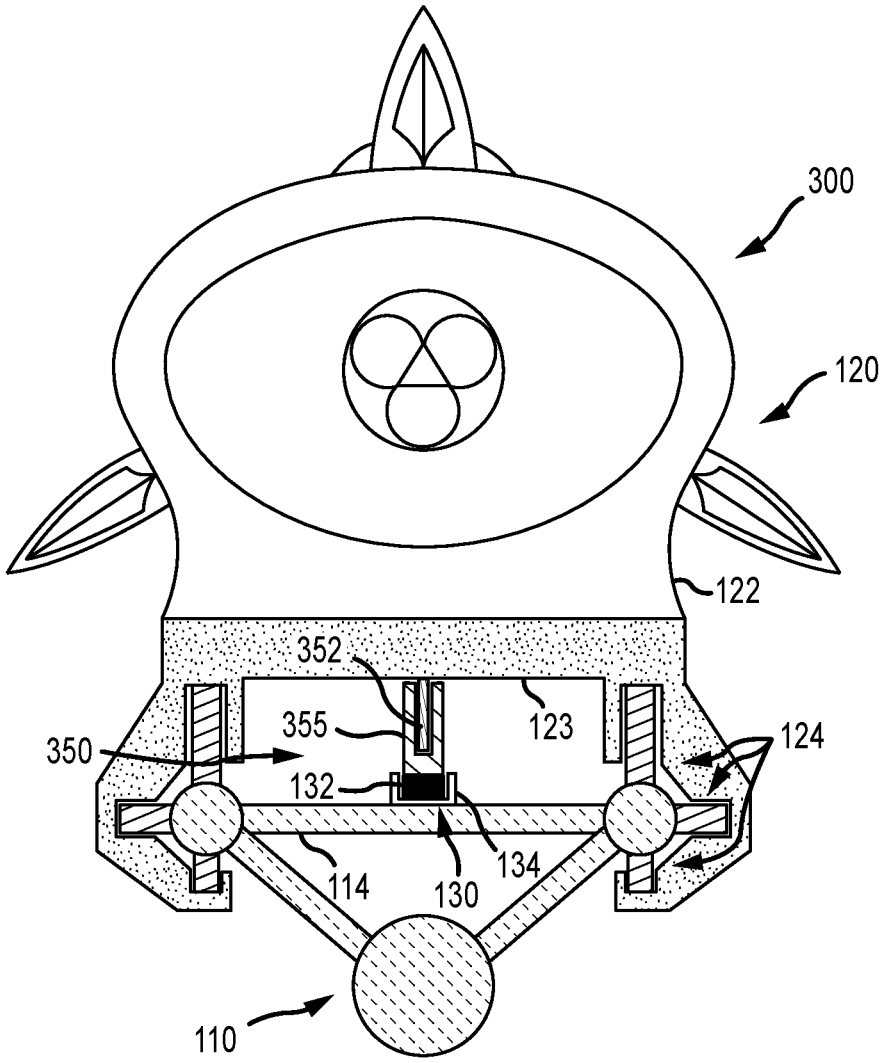
FIG. 3 is an end view similar to that of FIG. 2 showing a ride with another embodiment of the eddy current generator with the magnet/magnet array mounted on the links of the moving chain/support and the conductor or fin/plate of conductive material mounted on the base or bottom surface (s) of the vehicle body.

FIG. 3 is an end view similar to that of FIG. 2 showing a ride 300 with another embodiment of an eddy current generator 350, with other components of the ride 100 being retained. In the eddy current generator 350, a conductor 352 in the form of one or more fins/plates (e.g., relatively thin planar plates that may be square, rectangle, or other shaped) of conductive metal is included as the vehicle-mounted element. The conductor(s) is affixed to the base/bottom surface 123 of the vehicle body 122 so as to extend orthogonally from the base/surface 123 (such as in the center of the body 120 or some other known location). Again, the height of the conductor 352 is chosen to provide a desired pole projection area (or depth of penetration/engagement between the conductor and channel of the magnet/magnet array 355 with a greater height being preferred within space limitations for the ride 300) with the magnet/magnet array mounted on the links of the moving chain/support and the conductor or fin/plate of conductive material mounted on the base or bottom surface(s) 123 of the vehicle body 122.

The eddy current generator 350 also includes a plurality of magnets 355 (or an array of such magnets 355), and each has a U-shaped (or 2-sided) cross sectional shape and each is mounted on one (or more) links 132 of the support/chain 130. The magnets 335 are the support-mounted element of the generator 350 and are supported so that the spaced apart sidewalls (land channel there between) extend upward (e.g., orthogonally) from the track 110 (or its crossbars 114) toward the vehicle 120 as it passes over this section of the track 110 (section containing the moving support 130 with the support-mounted element 355). The set of magnets 355 positioned under the vehicle 120 while it is being lifted up the hill (or along the track 110) may have a combined length matching the length, $L_{Mag}$, of the magnet 152 in FIG. 1. The spacing between adjacent magnets 355 is typically only large enough to allow the magnets 355 to travel in a loop along with the moving support 130 (links of a chain as it travels over pulleys driven by one or more motors responding to control signals to travel at a predefined velocity, $V_S$).

In the embodiments shown in FIGS. 2 and 3, a two-sided magnet is shown, which creates a channel and/or is U-shaped in sectional shape. In other embodiments not shown, a planar or one-sided magnet may be used in place of either magnet/array 155 in the generator 150 or magnets 355 of the array shown in generator 350. Nearly any type of permanent magnet or magnetic material may be used to practice the invention such as a neodymium or the like, with magnets that produce stronger magnetic fields and/or provide a higher magnetic flux density being preferred in some cases to generate a larger eddy current, to allow use of a smaller magnet and/or fewer magnets in an array, and/or to allow a smaller pole projection area to be utilized.

Figure 4:
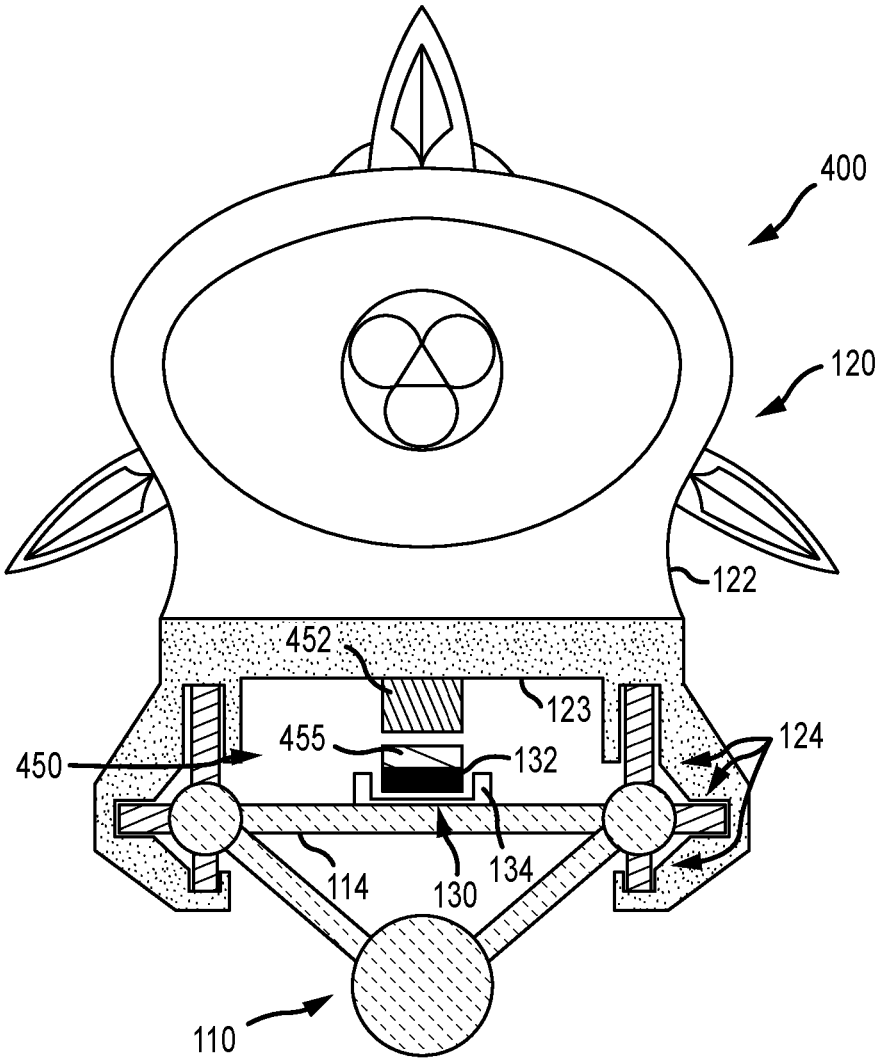
FIG. 4 is an end view similar to FIGS. 2 and 3 showing a ride with an additional embodiment of the eddy current generator with both the magnet(s) and the conductor(s) being selected to be flat/planar and arranged to be parallel as the two come into close proximity within the illustrated section of track (to generate the eddy current)

FIG. 4 is an end view, similar to FIGS. 2 and 3, showing a ride 400 with an additional embodiment of an eddy current generator 450. In this embodiment of the generator 450, both the magnet(s) and the conductor(s) are selected to be flat/planar and arranged to be parallel as the two come into close proximity within the illustrated section of track (to generate the eddy current), and the magnet may be mounted on the moving support or on the vehicle with the conductor provided on the opposite surface (e.g., on the vehicle or on the moving support). In this regard, FIG. 4 shows that the vehicle-mounted element 452 and the support-mounted element 455 both are planar (rectangular in cross section) and arranged to be parallel to each other. The vehicle-mounted element 452 may be a magnet or array of magnets or a conductor(s) with the support-mounted element 455 being a conductor (or array of conductors) or a magnet (or array of magnets). Again, the clearance or spacing is preferably kept large enough to avoid contact between the elements 452, 455 but as small as practical to increase the efficiency of the eddy current generator 450.

Figure 5:
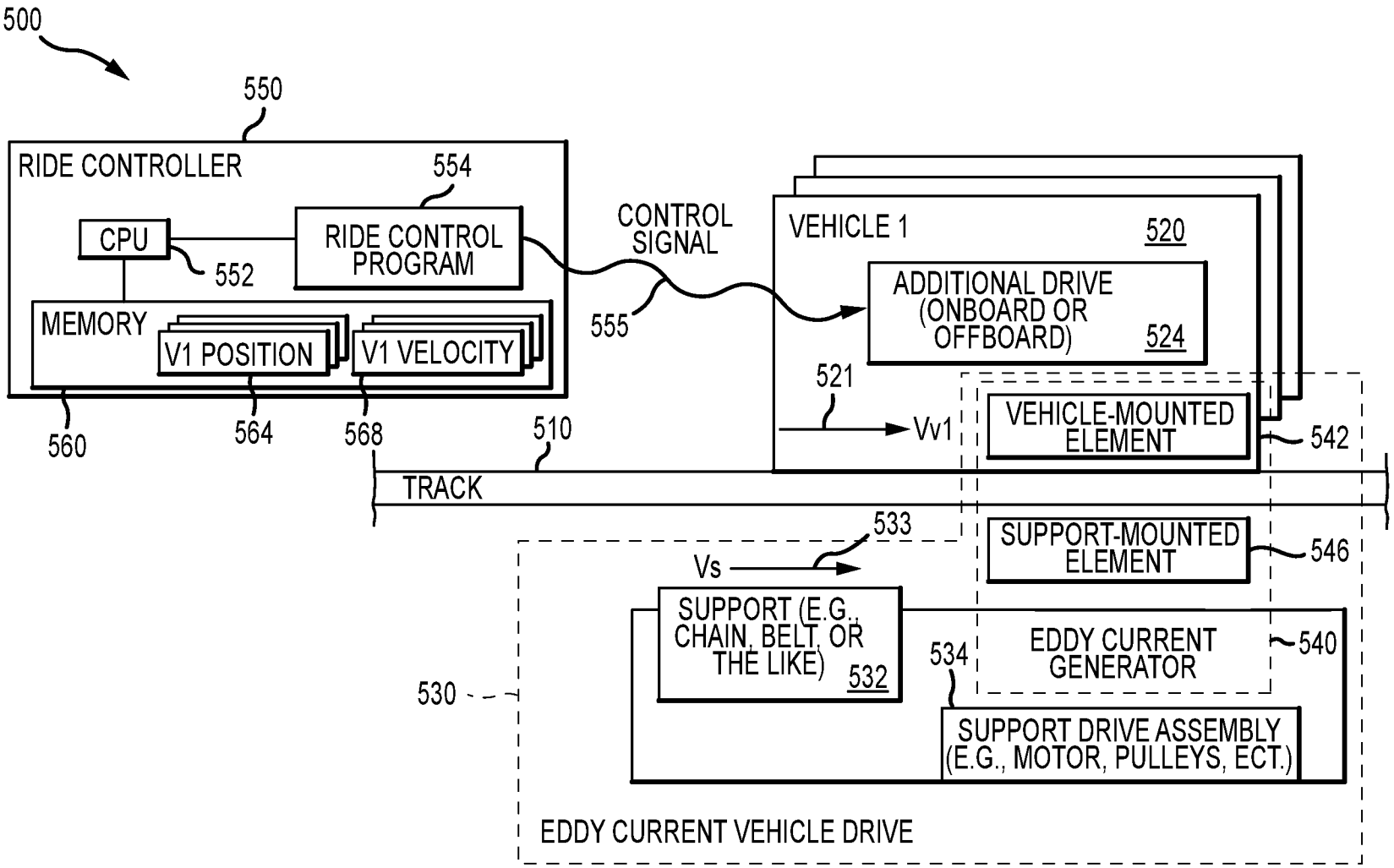
FIG. 5 is a functional block diagram of a ride (or transportation system) of the present description with an eddy current vehicle drive.

FIG. 5 is a functional block diagram of a ride 500 that utilizes an eddy current vehicle drive 530 to drive or move a plurality of vehicles (including a first vehicle 520) along a section of a track 510 (such as up a lift hill in a roller coaster implementation). The ride 500 includes an additional drive 524 that is provided onboard each vehicle 520 or offboard that is operable via a ride controller 550 (and its generated/transmitted control signals 555) to adjust the vehicle's velocity, $V_{V1}$, as it travels in the track section 510. To this end, the ride controller 550 includes a processor 552 running or executing code to provide the functionality of a ride control program 554, which may be configured to set a spacing between vehicles 520 and/or the current location/position of each vehicle 520 by adjusting the vehicle velocity, $V_{V1}$, in the section of the track 510.

The inclusion of the additional drive 524 allows the controller 550 to drive each vehicle 520 independently at differing velocities in the track section 510 that may be slower or greater than the support velocity, $V_S$, with the drive 524 operating to overcome the force applied by the eddy current vehicle drive 530 on the vehicle 520. The controller 550 further includes a memory 560 storing ride data including the current vehicle velocities 564 as well as the current vehicle positions 568 both of which may be processed by the ride control program 554 to determine when to issue the control signals 555 to operate the additional drive 524 in the track section 510 and when to simply allow passive driving of the vehicles 520 through the track section 510 by ongoing operations of the eddy current vehicle drive 530.

The ride 500 also includes an eddy current vehicle drive 530 that operates to drive each vehicle including vehicle 520 at a velocity, $V_S$ (or slightly below as a difference is needed to generate an eddy current). The eddy current vehicle drive 530 includes a support 532 such as a belt, a chain, a cable, or the like that moves in a continuous manner (such as along a closed, loop-shaped path) at a typically constant velocity, $V_S$. At any given time in the operation of the ride 500, a length of the support 532 is positioned proximate to the track 510 (such as between its rails as shown in FIG. 2) so as to move parallel to the path defined by the track 510 and to move in the same direction as the vehicle 520 (and, often, to be in a plane that is parallel to the vehicle's base/lower surface when the vehicle 520 travels nearby the support 532). To provide this continuous motion, the ride 500 includes a support drive assembly 534 that may use a motor to drive one or more gears, pulleys, or the like to cause the support 532 to move at the velocity, $V_S$ (e.g., 0.5 to 2 m/s or more), in the desired direction.

The eddy current vehicle drive 530 also includes an eddy current generator 540. The generator 540 includes a vehicle-mounted element 542 and a support-mounted element 546. As discussed above, one of the elements 542 or 546 is a magnet (or array of magnets) while the other of the elements 546 or 542 is a conductor (or array/series of conductors). A driving or motive force (non-contact and non-mechanical engagement/linking force) is applied by the eddy current generator 540 upon the body of the vehicle 520 when an eddy current is generated. An eddy current is generated when the two elements 542 and 546 move relative to each other at differing speeds such as when the support velocity, $V_S$, is a small amount greater (or less) than the vehicle velocity, $V_{V1}$. In this situation, the relative movement of the adjacent magnet and conductor provided by elements 542, 546 generate an eddy current that causes a driving force to move the vehicle 520 through the track section 510 (attempt to move the vehicle 520 at the support speed, $V_S$).

With regard to calculation of the differential velocity useful to implement the new drive, the magnitude of the drag force ($F_d$) caused by the eddy current effect is calculated using multiple variables that describe the system. These variables include: α, a constant based on the sue of a continuous conductor plate; σ, the conductivity of the conductor plate; δ, the thickness of the conductor; β, the magnetic flux density of the permanent magnet array; and l and w represent the length and width of the pole projection area created by the rectangular permanent magnet array. The drag equation is given as: $F_d=\alpha(\sigma\delta(\beta_0)^2 lw)v$. The v term represents the relative velocity between the conductor fin and the magnet array and is the variable to be solved.

Since it is desired for the vehicle to be carried up the lift hill, the drag force will be equal to the "downhill" portion of the total weight of the vehicle (including passenger weight). The relative velocity can be calculated by defining the geometry of the system. In this calculation, the weight of the vehicle and number of passengers were modeled on a vehicle presently used today at an amusement park. In keeping with this analogy, the length and width (height) of the conductor fin were modeled after the brake fin on the vehicle. The two big variables that really effect the efficiency of the system are the conductivity of the conductor plate and, more importantly (since it is squared in the above equation), the magnetic flux density of the magnet array. A magnetic flux density of 1.0 Tesla (on the low end of the flux spectrum for neodymium magnets) was used. It was assumed that a dual-sided magnet array that has a more consistent magnetic flux density between the two sides was used, as opposed to a single-sided magnet array where magnetic flux density falls away very quickly as one moves away from the magnet array (proportional to the inverse cube of the distance from the magnet array, $1/r^3$).

The following provides the values used for each of the variables along with the calculated relative velocity between the chain and the vehicle: $F_d$=11787.88 N; α=0.072178; σ=1.72E+08 1/Ωm; δ=0.02 m; $\beta_0$=1 T; l=2.97 m; w=0.15 m; and v=0.106 m/s. The relative velocity between the conductor fin and the vehicle magnet array is 106 mm per second. This means that the vehicle slips 106 mm for every second the vehicle is on the lift. This is using a copper conductor fin with a relatively high conductivity value. Even though this is an efficient system of energy transfer (92 percent efficiency at this velocity), there are ways to improve it such as by: (a) increasing the thickness of the conductor plate; (b) increasing the magnetic field projection area; and (c) increasing the magnetic flux density. Based on the above calculations, use of the new eddy current vehicle drive in a ride (or other transportation environment) is feasible such as for use as a replacement for a traditional chain drive in a roller coaster or other ride.

With regard to comparative system efficiency (with respect to an LSM lift), the eddy current chain lift uses two forms of energy transfer that reduce the efficiency of the system. First is the electric energy transfer into mechanical energy in the form of an electric motor. Electric motors at this horse power (e.g., about 25 HP for this specific system)

are approximately 90 percent efficient per NEMA Premium standards. The second form of energy transfer is between the chain conductor fin and the vehicle magnet array as discussed above. Since the eddy current effect requires a differential velocity between the conductor and magnet, there is an inherent inefficiency that is directly proportional to the amount of "slip" seen be the vehicle with respect to the chain (support). This inefficiency can be reduced through multiple factors such as: creating an increased magnetic flux density through optimization of the vehicle's magnet array; using greater magnetic strength; and using geometric optimization. The inefficiency in this eddy current configuration equates to about an 8 percent loss. The overall system efficiency, including the electric motor and eddy current system, equates to around 83 percent.

Similarly, the LSM drive system only has one source of energy transfer, which is between the LSM and the vehicle's magnet array. Theoretically, LSMs can be as efficient as traditional rotary electric motors, except that the gap between the magnet array and the stator are larger due to required vehicle clearances (similar to the eddy current chain). LSM efficiencies are traditionally around 70 percent but have been optimized to as high as 90 to 95 percent. Since the efficiency of both systems is dependent on factors under the designer's control (such as magnet gap, pole optimization, motor optimization (core material and the like), driving velocity, and permanent magnetic material (optimized magnetic flux density)), the systems are comparable with respect to efficiency. Each one can be optimized for the required use to achieve an efficiency that is less than a traditional chain lift but on the same order of magnitude.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The eddy current vehicle drive presents a number of advantages over conventional chain lifts. There is no way for the vehicle to "slip" on the chain that can lead to significant impact loads on the passengers or vehicle equipment because the system is designed slip. The eddy current vehicle drive is designed to only resist the motion of the vehicle rolling backwards and not to stop it. This is still a safe condition and highly predictable, as even if the chain stops moving up hill, the motion of the vehicle moving backwards is enough to induce an eddy current that resists the motion of the vehicle keeping it at a predictable, low velocity for a safe and low energy stop. This predictable roll back condition reduces the need for a separate ARB system.

Additionally, since no part of the drivable or movable support assembly/system is in contact with any vehicle on the ride/transportation system, the vehicles can be moved at a different velocity than the chain, belt, or other moving support component. In such embodiments, an additional drive (onboard or offboard) is included for braking and/or accelerating the vehicle while they are "engaged" with the drivable/movable support system. The eddy current only "resists" velocities other than that of the moving support (chain, belt, or the like) carrying the support-mounted element of the eddy current generator. Therefore, it is entirely feasible for multiple vehicles on the eddy current-driven section of the ride/system to be moving at different velocities (at the speed of the support, slower than the speed of the support, and faster than the speed of the support). With such an embodiment, the eddy current vehicle drive allows for "correction" of any issues such as issues with a ride's dispatch interval. For example, if one vehicle is behind the expected dispatch interval due to passenger loading issues (a common problem on attractions and/or rides), it can be sped up, via operations of the additional drive, on the section of track containing the support-mounted element of the eddy current generator to ensure the ride/system is not negatively affected (such as with a cascade stop that can reduce passenger capacity and/or show features on the ride/attraction).

Previous techniques for moving a vehicle in a ride (or in other transportation systems) had issues that are solved with the new eddy current vehicle drive. Cable lift systems use a cable in place of a chain. Since the vehicle cannot attach to a cable like it would on the rung of a chain, the cable lift has a "catch car" that is attached to the cable in one location and runs in a track of its own for guidance. This catch car attaches to the vehicle mechanically in a similar fashion to the traditional chain lift. There is only one place the vehicle can catch the cable lift so the vehicle must be stationary in order to engage with the catch car. This insures the vehicle does not miss the catch car and roll back down the lift hill. The cable is then pulled up the lift hill with the vehicle attached, which removes the possibility of high loads and accelerations from slipping on a chain. Once the vehicle reaches the top of the lift hill, it is released from the catch car allowing the vehicle to continue down the track. The catch car must then return back down the lift hill in the direction it came from (it is in a non-continuous track) to meet the next vehicle that will be lifted to the top.

The cable lift system has many limitations when compared to an eddy current lift system (or eddy current vehicle drive). First, like the traditional roller coaster chain lift, the cable lift is a mechanical system that requires parts from the vehicle to physically interact with parts from the lift. The physical interaction of these parts will naturally cause the parts to wear with time and repeated use/interaction, which will require maintenance and eventual replacement. Second, the cable lift also must be stationary to properly engage with the vehicle, which may lead to timing issues on multiple lift-type rides/attractions. Third, since the cable lift only has one "catch car" and this catch car runs in a track that does not continue after the lift hill, the cable lift must reverse its direction to move the catch car back to the loading zone after it dispatches a vehicle. This action takes a significant amount of time and may impact the passenger capacity of the ride/attraction. Fourth, only one "catch car" can exist on the cable lift so this lift can only have one vehicle on it at a time.

Some rides/attractions have used LSM/LIM-type drive systems. Linear synchronous motor (LSM) or linear induction motor (LIM) lift systems may be used as a solution to some of the problems associated with chain lifts and cable lifts. These drives contain a series of LSM or LIM motors on the entire length of the lift hill. These motors are commanded to create a magnetic force that pushes against a magnet or magnet array on the vehicle, thereby propelling the vehicle up the lift hill. Since the vehicle is not mechanically linked to the lift mechanism, there is no wear on the system and no possibility of impact loads from a vehicle slipping on a mechanical item.

The eddy current vehicle drive has a number of advantages over the LSM/LIM-type lift. First, the eddy current vehicle drive does not require active controls to drive the vehicle up the lift hill. The eddy current vehicle drive acts passively on the vehicle since only the support (chain, belt, or the like) is being driven during operation of a ride/system. Second, the LSM/LIM system requires a significant amount of software (and hardware) to make it work properly. Since each of the motors needs to be driving the vehicle at a very specific time, when the vehicle is over the specific motor, it takes a great deal of software control to ensure this is happening at the right time. The eddy current vehicle drive is a much simpler system from a software or control standpoint as it is effectively controlled in the same way as a traditional chain lift. It does not require any special software that has not already been designed or maintained in the past. Third, since the LSMs/LIMs required precise information about where the vehicle is at all times and how much to "drive" the vehicle, these systems contain advanced instrumentation and sensors that significantly drive up the cost of these motors. Fourth, the LSM/LIM system drives the specific motor that the vehicle is over and requires a brief high electric current to drive a vehicle up the lift hill. In some cases, this requires additional energy storage units or a new substation to ensure the local energy grid is not negatively affected by a spike in energy consumption.

I claim:

1. A system for moving vehicles at a desired velocity through a space by applying a non-contact driving force, comprising:

a vehicle configured to be movable along a predefined path;

a support;

a support drive assembly operating to move the support at a support velocity along a travel path that is proximate to and parallel to the predefined path; and an eddy current generator comprising a vehicle-mounted element and a support-mounted element, wherein the vehicle-mounted element is supported on a surface of a body of the vehicle that faces the predefined path, wherein the support-mounted element is positioned on the support to face the vehicle when the vehicle is moved onto the predefined path at a vehicle velocity differing from the support velocity, and wherein the eddy current generator generates an eddy current to apply a drive force on the body of the vehicle to drive the vehicle along the predefined path.

2. The system of claim 1, wherein the support comprises a chain, a belt, or a cable.

3. The system of claim 1, wherein the vehicle-mounted element comprises a magnet and wherein the support-mounted element comprises a conductor.

4. The system of claim 3, wherein the magnet has a U-shaped cross sectional shape defining a channel between two sidewalls, wherein the conductor comprises a planar plate extending outward from the support, and wherein the planar plate is received within the channel when the eddy current generator generates the eddy current.

5. The system of claim 3, wherein the magnet comprises one or more permanent magnets and wherein the conductor comprises an electrically conductive material.

6. The system of claim 1, wherein the vehicle-mounted element comprises a conductor and wherein the support-mounted element comprises a magnet or magnet array.

7. The system of claim 1, wherein the drive force is applied without physical contact or linkage between the body of the vehicle and the support-mounted element and wherein the support-mounted element and the vehicle-mounted element are positioned to be spaced apart as the vehicle travel along the predefined path.

8. The system of claim 1, further comprising a track with a section coinciding with the predefined path, wherein the vehicle is adapted to roll upon the track, and wherein the support is positioned adjacent to the track, whereby the support-mounted element is moved at the support velocity along the section of the track.

9. An eddy current vehicle drive for use in moving a vehicle along a section of track, comprising:

a support assembly including a support and a drive mechanism moving the support adjacent the section of track at a support velocity; and an eddy current generator comprising a vehicle-mounted element attached to a body of the vehicle and a support-mounted element provided on the support, wherein a first one of the vehicle-mounted element and the support-mounted element includes a magnet, wherein a second one of the vehicle-mounted element and the support-mounted element includes a conductor, and wherein an eddy current is generated when the vehicle-mounted element and the support-mounted element are positioned side-by-side and when the vehicle is moving on the section of the track at a vehicle velocity differing from the support velocity.

10. The eddy current vehicle drive of claim 9, wherein the magnet comprises a magnet with a U-shaped cross section, wherein the conductor comprises a planar fin formed of an electrically conductive material, and wherein the planar fin extends between two sidewalls of the U-shaped magnet when the vehicle-mounted element and the support-mounted element are positioned side-by-side in the section of the track.

11. The eddy current vehicle drive of claim 10, wherein the planar fin and the two sidewalls have an overlap when the vehicle-mounted element and the support-mounted element are positioned side-by-side in the section of the track.

12. The eddy current vehicle drive of claim 10, wherein the U-shaped magnet is mounted on a bottom surface of the vehicle, wherein the conductor comprises a plurality of the planar fins mounted on surface of the support facing the bottom surface of the vehicle.

13. The eddy current vehicle drive of claim 9, wherein the vehicle velocity differs from the support velocity and wherein the support comprises a chain, a belt, or a cable.

14. The eddy current vehicle drive of claim 9, wherein the vehicle-mounted element and the support-mounted element overlap when in the side-by-side position by a length and a height.

15. A system for moving vehicles at a desired velocity through a space by applying a non-contact driving force, comprising:

a vehicle adapted for rolling along a ride path; and an eddy current vehicle drive comprising:

a first element mounted upon a body of the vehicle;

a support adapted for being moved adjacent to a section of the ride path at a support velocity greater than zero when the vehicle is rolling along the ride path; and a second element mounted on the support, wherein the first and second element are positioned adjacent to each other when the vehicle is on the section of the ride path and wherein an eddy current is generated when the vehicle is moving on the section of the ride path at a vehicle velocity differing from the support velocity, whereby the generated eddy current drives the vehicle to move along the section of the ride path.

16. The system of claim 15, wherein the first element comprises a magnet and wherein the second element comprises a conductor.

17. The system of claim 16, wherein the magnet has a U-shaped cross section, wherein the conductor comprises a plurality of planar fins extending outward from the support.

18. The system of claim 17, wherein a subset of the planar fins is received within a channel of the magnet when the vehicle is on the section of the ride path.

19. The system of claim 17, wherein the support comprises a chain comprising a plurality of links and wherein the planar pins are each mounted upon one of the links.

20. The system of claim 19, wherein the magnet and the conductor overlap to define a projection height when the vehicle is on the section of the ride path.

* * * * *